United States Patent [19]

Farnworth et al.

[11] Patent Number: 5,005,902

[45] Date of Patent: Apr. 9, 1991

[54] SEAT FOR A BABY

[76] Inventors: Wendy E. Farnworth; David J. Farnworth, both of 12 Mill Lane, Felixstowe, Suffolk IP11 7RN, Great Britain

[21] Appl. No.: 596,758

[22] Filed: Oct. 10, 1990

Related U.S. Application Data

[63] Continuation of Ser. No. 375,611, Jul. 5, 1989, abandoned.

[30] Foreign Application Priority Data

Jul. 6, 1988 [GB] United Kingdom ..... 8816108

[51] Int. Cl.[5] ..... A47D 1/10

[52] U.S. Cl. ..... 297/250; 257/DIG. 3; 5/417

[58] Field of Search ..... 297/250, 485, 452, DIG. 3, 297/191; 5/455, 461, 462

[56] References Cited

U.S. PATENT DOCUMENTS

| | | | |
|---|---|---|---|
| 3,712,674 | 1/1973 | Ando | 297/DIG. 3 |
| 3,781,931 | 1/1974 | Knickerbocker | 297/DIG. 3 |
| 4,227,270 | 10/1980 | Rivera | 5/417 X |
| 4,484,781 | 11/1984 | Phelps | 5/455 |
| 4,601,667 | 7/1986 | Hull | 297/250 X |
| 4,681,195 | 7/1987 | Traham et al. | 5/417 X |
| 4,724,558 | 2/1988 | Reiff | 297/DIG. 3 |
| 4,759,588 | 7/1988 | Husnik | 297/250 X |
| 4,836,605 | 6/1989 | Greenwood | 297/DIG. 3 |

*Primary Examiner*—Peter A. Aschenbrenner
*Attorney, Agent, or Firm*—Charles D. Gunter, Jr.

[57] ABSTRACT

An inflatable baby seat has a non-inflatable base of a size just suitable for a baby to sit upon. The base is surrounded by inflatable walls. The walls are supported on the outside by inflatable support cushions to prevent the walls being pushed over when the baby leans on them. The walls support the baby and prevent it falling over when it is seated in the seat and the seat is placed on a floor.

16 Claims, 4 Drawing Sheets

SEAT FOR A BABY

This application is a continuation of application Ser. No. 07/375,611, filed 07/05/89, now abandoned.

This invention relates to a seat for a baby, and in particular to a seat for a baby which is old enough to be able to sit up, but not old enough to be stable when seated.

There is a stage in the development of babies where they can sit up, but where they need to be watched or supported all the time because they are liable to overbalance and then be unable to get themselves upright again. It is inconvenient to have to watch such a baby continuously, and it is known to place cushions all round the baby in order to prevent the baby from falling over.

According to the present invention there is provided an inflatable seat for a baby, the seat comprising a non-inflatable base, an inflatable wall upstanding from part of the periphery of the base to support a baby seated on the base and to prevent and baby falling backwards or sideways, and an inflatable support cushion or cushions arranged outside the wall and at the bottom edge of the wall to add stability to the wall.

The base is preferably also non-rigid and may be formed from sheet plastic material. The use of a non-inflatable base means that the centre of gravity of the baby is as low as possible when seated in the seat. Furthermore, the use of a non-rigid construction combined with the inflatable construction of the rest of the seat enables the seat to be folded away to a small package before and after use.

The base is preferably generally rectangular (in one particular form it may be horseshoe-shaped), and the wall surrounds three sides of the base, leaving one edge of the base open. One side of the base is preferably open so that the baby's feet can project and so that the baby is not "shut in".

There may be a single support cushion extending all round the periphery of the wall, or alternatively there may be a number, suitably three, cushions arranged at suitable positions aroiund the wall. The cushions are preferably arranged so that they form a buttress for the wall.

The seat may include internal anchoring points to which a baby's restraining harness can be clipped, and external anchoring points so that the seat can be secured in, for example, a pram.

The walls of the seat can include pockets or loops, preferably on the outside, in which toys or feeding utensils can be placed.

The height of the inflatable wall is preferably greatest behind the baby, and may taper downwards from this point towards the point at which the baby's feet will be.

The base may be made of two sheets of plastics material with the space between the sheets providing a storage space in which, for example, a folded-up chaning mat can be placed.

The inflatable wall may be constructed with a plurality of inflatable chambers, and in a preferred form all the chambers intercommunicate so that they can be all inflated through a single inflation valve. It may also be possible for the inflatable support cushions to also intercommunicate with the inflatable chambers in the walls, so that these can also be inflated at the same time as the walls.

All of the inflatable areas can be formed in one manufacturing step using two superimposed sheets of plastics material which are welded to one another around the edge and at other suitable positions to define the desired shape of the walls and cushions.

The invention will now be further described, by way of example, with reference to the accompanying drawings, in which:

FIG. 1 is a perspective view of a baby seat in accordance with the invention;

FIG. 1*a* shows a cross section through the seat of FIG. 1;

Figure 1:
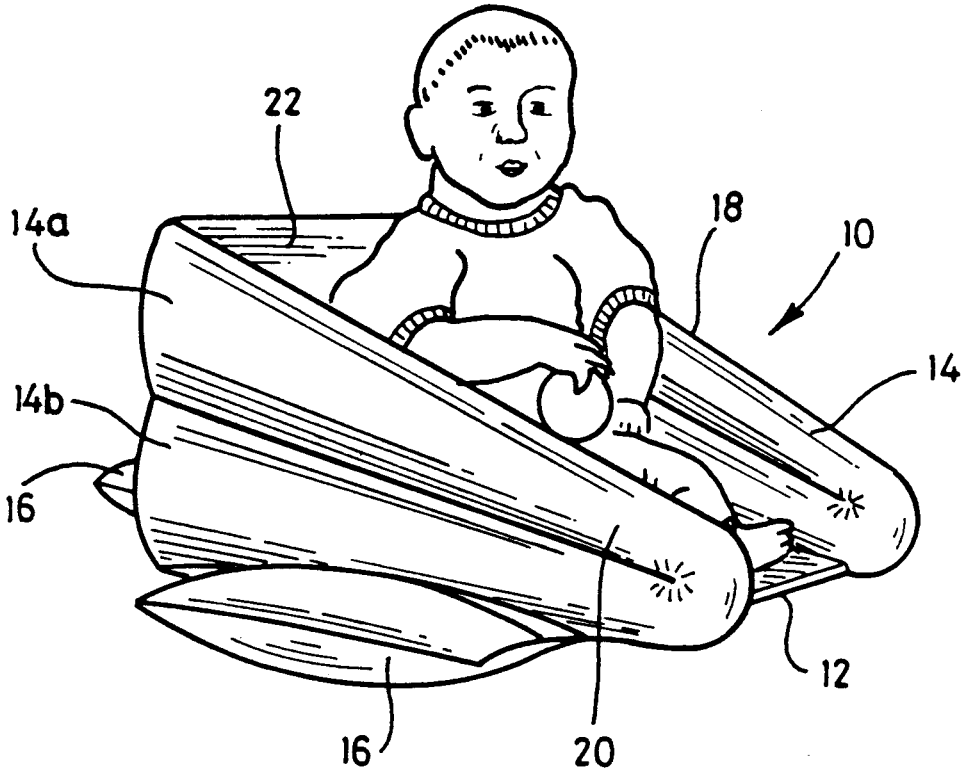

FIG. 1 shows a seat generally designated 10 with a base 12 and a peripheral wall 14. The wall is formed by an inflatable body which has an upper region 14*a* and a lower region 14*b*. Around the lower edge of the peripheral wall are three inflatable suport cushions 16.

When seen in plan view, the wall 14 has two sides, 18 and 20 and a back 22.

In use, the inflated seat is placed directly on the floor (or possibly on any other surface where the baby is to be seated). The baby is then seated on the base 12, and because the base 12 is not inflated there will only be the thickess of sheet of plastics material between the baby's bottom and the floor. The baby's centre of gravity will therefore be at the same position relative to the floor as if he or she was sitting directly on the floor, and this is important in giving the baby a sense of security and in aiding the baby's development towards a self-supporting sitting position.

Figure 1A:
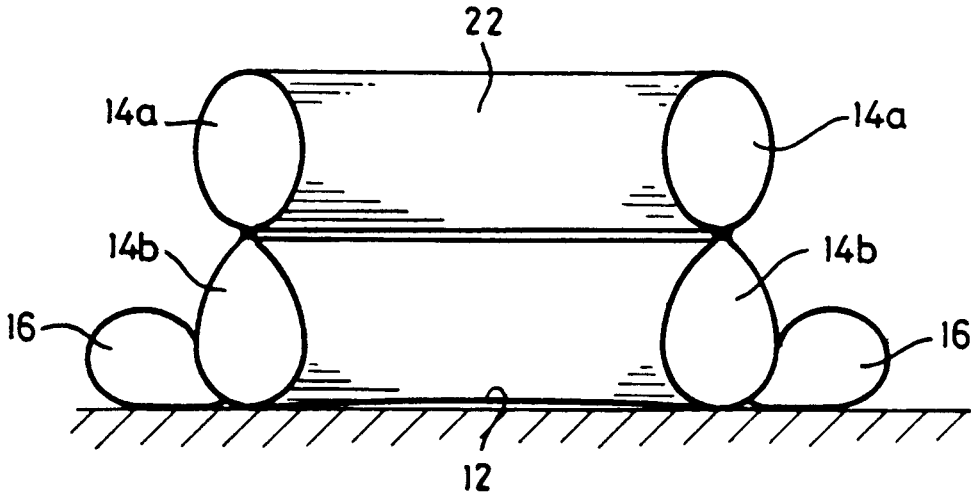

Babies for whom the seat is intended will not however be capable of reliably sitting upright on their own. When a baby placed in the seat topples sideways, he or she will topple against one of the walls 18 or 20, and will therefore not fall over. In order to ensure that the walls remain in their upright position, the inflatable cushions 16 are positioned as shown and will prevent the wall itself falling over. This can be seen particularly from the cross sectional view shown in FIG. 1*a*, where it will be seen that if the wall tends to topple outwards, the resistance to such movement by the cushion 16 will increase.

Figure 2:
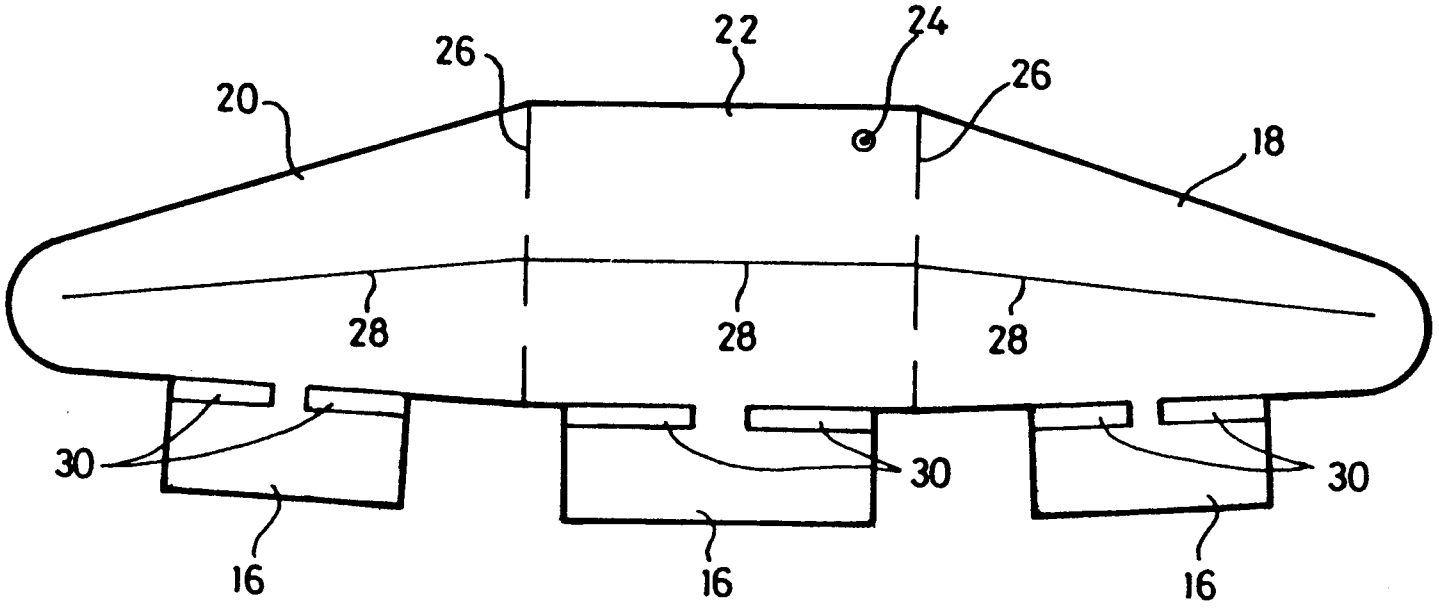
FIG. 2 is a developed view showing part of the construction of the baby seat of FIG. 1.

FIG. 2 shows how the inflatable areas of the seat can be constructed from two sheets of plastics material each of which has the peripheral shape by the external bold line shown in FIG. 2. The two sheets are placed one on top of another and are heat sealed together both around their edges and along the internal lines shown in FIG. 2. It will be apparent that the internal lines are interrupted so that the whole of the interior of this inflatable body consists of intercommunicating chambers, all of which can be inflated through a single inflation valve 24. In particular, the back 22 is separated from the side walls 18, 20 by vertical sealing lines 26 which allows the completed body to be erected in a three-sided shape aftr inflation as shown in FIG. 1. The horizontal heat sealing lines 28 divide the walls in the back into upper and lower regions 14*a*, 14*b* and the wider bands of heat sealing at 30 provide a narrow inflatable band between the bottoms of the walls and the inflatable cushions 16.

Figure 3:
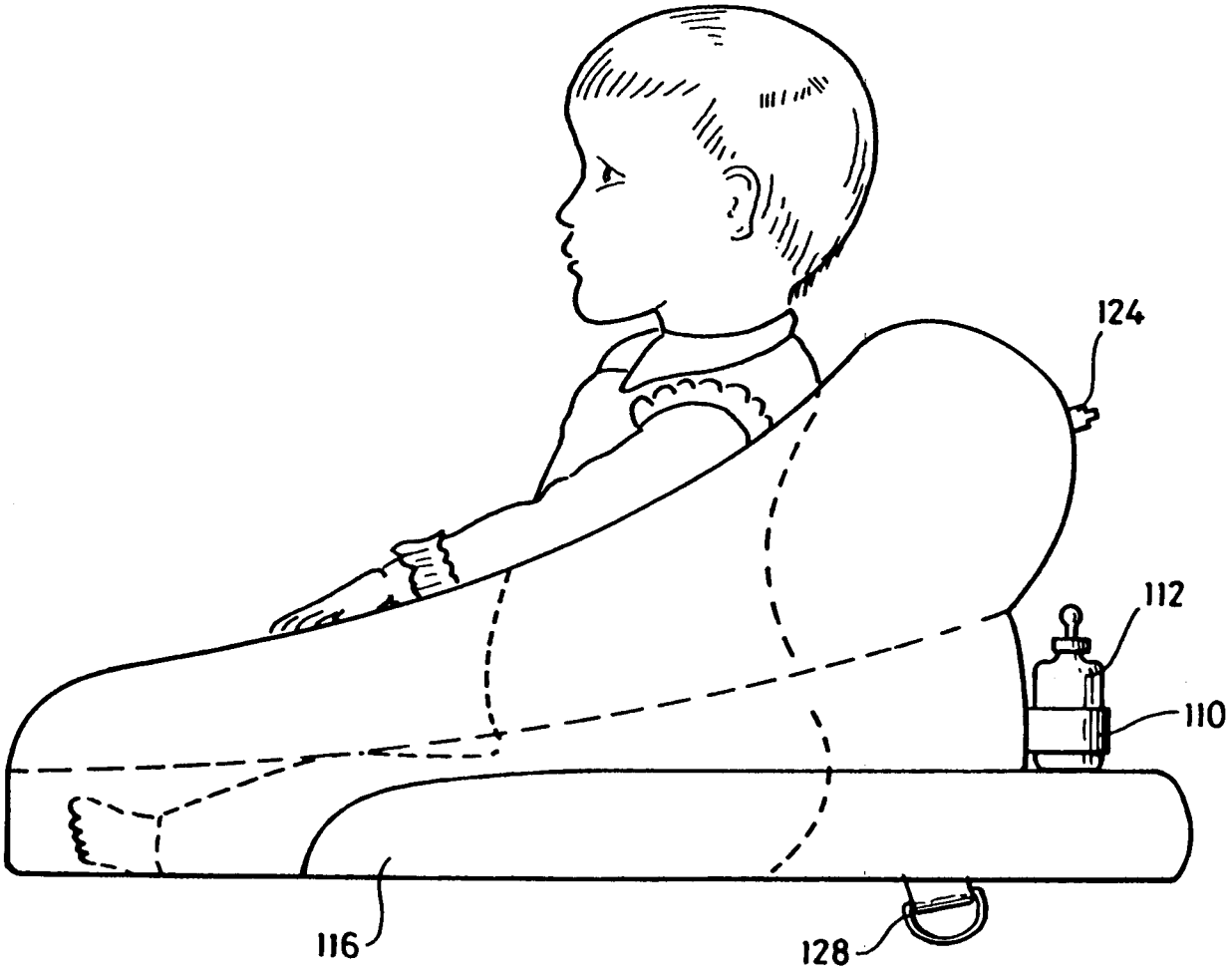
FIG. 3 is a side view of a second embodiment of seat in accordance with the invention.
Figure 4:
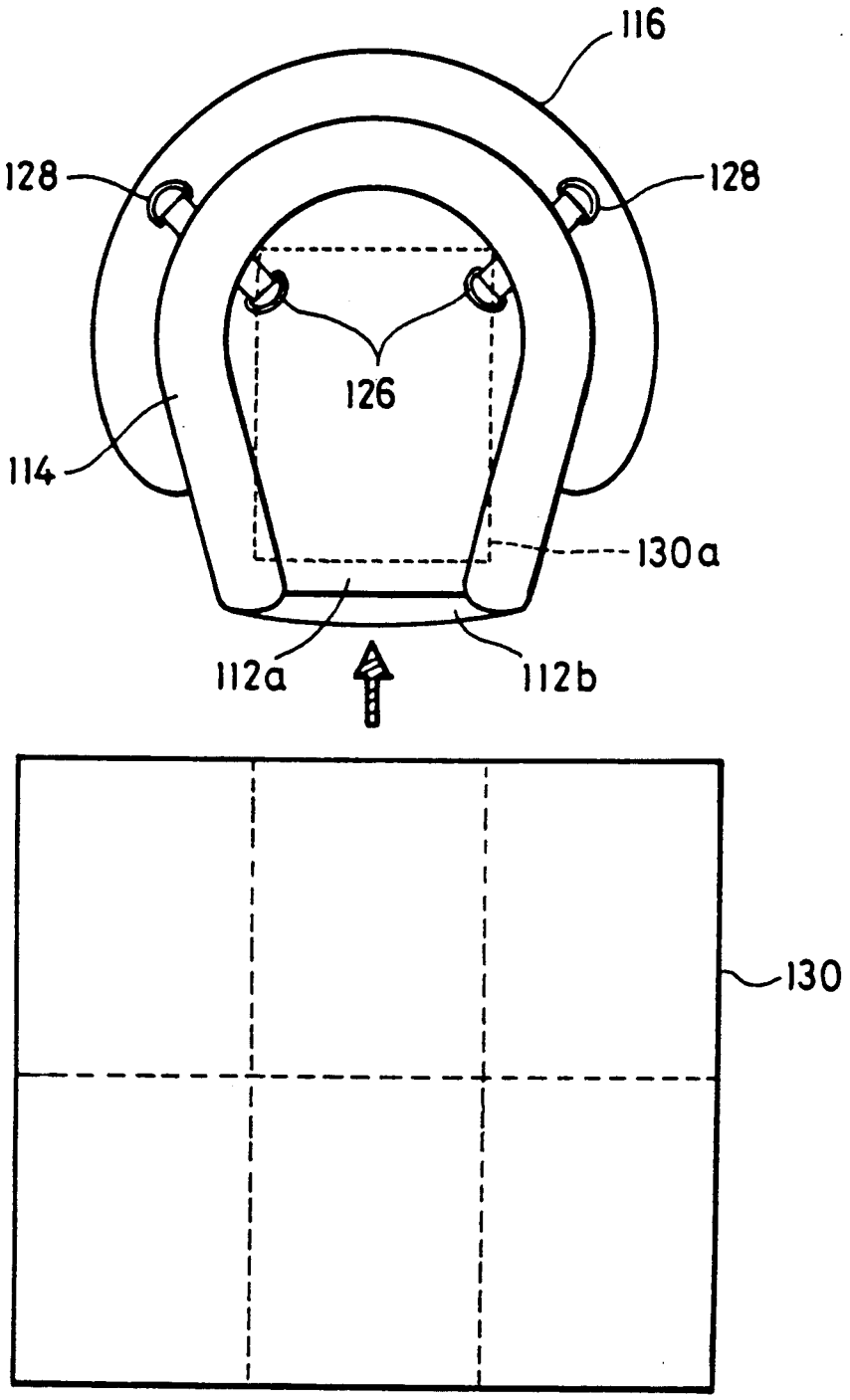
FIG. 4 is a plan view of the seat of FIG. 3.

In the embodiment shown in FIGS. 3 and 4, the shape of the seat, in plan view, is a horeshoe shape rather than the three sided shape shown in FIGS. 1 and 2. Apart from this difference however features shown on the first embodiment are interchangeable with those shown on the second embodiment.

In FIGS. 3 and 4 also, there is a continuous support cushion 116 shown around the lower edge of the side wall.

FIG. 3 shows an additional feature in the form of a loop 110 which may be used, for example, for holding the bady's feed bottle 112, and in a similar way a pocket could be mounted on the exterior of the wall to hold toys or other objects. FIG. 3 shows how the valve 124, in the inflated condition of the seat, is located on the outside. FIG. 3 also shows how the shape of the rear wall of the seat can be contoured to assist in developing the baby's posture.

The seat may incorporate permanently attached anchorage points 126, 128 with the internal anchorage points 126 being intended to secure the baby in the seat, and the external anchorage points 128 being intended to secure the seat to some other structure.

Furthermore, the base 112 can be formed of a double thickness of material with an upper layer 112*a* and a lower layer 112*b* which form a pocket between them, the pocket being open at the front in the direction of the arrow shown in FIG. 4. Inside this pocket, a changing mat can be stowed. This changing mat is shown in the folded up and stowed condition at 130*a* in FIG. 4, and also in the opened out position ready for use at 130.

The seat described is easy to carry around and does not require any complicated assembly procedure when it is to be used. Since it is inflatable it can be packed down into a very small space when deflated which will assist the users of the seat in storing the seat when it is not in use, and will also assist manufacturers and retailers in that the seat can be transported and displayed on the shelves of a shop without taking up an undue amount of space. When inflated, the seat will provide secure and comfortable support for a baby.

The two shapes shown in the drawings (the three-sided and horseshoe shape) have both been found to be very effective in supporting a baby, but the invention extends to differently shaped seats, provided that there is a side and back rest surrounding the periphery of the base and occupying about 210° of arc.

It is suggested that the maximum height of the wall 22 behind the baby should be about 30 cm and that the minimum height of the wall at the open end of the seat should be about 15 cm. The main requirement however is that the wall height at the back and at the sides where they meet the back should be about shoulder height when the baby is sitting in the seat. The gradual reduction in the height of the walls as shown allows the baby to move its arms freely.

We claim:

1. A support for a seated baby for supporting a baby in a sitting position on a floor, the seat comprising a non-inflatable base which, in use, will lie flat on the floor, the non-inflatable base having a front edge, a rear edge, and opposing side edges, an inflatable wall upstanding from part of the periphery of the base and surrounding the rear edge and opposing sides edges to support a baby seated on the base and to prevent the baby falling backwards or sideways, the front edge of the base remaining open to define a front opening, whereby legs of a baby supported on the base extend in the direction of the front opening at approximately floor level, whereby the baby's center of gravity is at the same position relative to the floor as if the baby were sitting directly on the floor, and at least one inflatable support cushion arranged outside the wall and at the bottom edge of the wall to add stability to the wall.

2. An inflatable seat as claimed in claim 1, wherein the base in non-rigid.

3. An inflatable seat as claimed in claim 2, wherein the base is formed from sheet plastic material.

4. An inflatable seat as claimed in claim 2, wherein the base is generally rectangular and the wall surrrounds three sides of the base, leaving one edge of the base open.

5. An inflatable seat as claimed in claim 2, wherein the base is horseshoe-shaped.

6. An inflatable seat as claimed in claim 1, wherein there is a single support cushion extending all round the periphery of the wall.

7. An inflatable seat as claimed in claim 1, wherein there are a number of cushions arranged at suitable positions around the wall.

8. An inflatable seat as claimed in claim 7, wherein the wall surrounds three sides of the base and there are three cushions, one associated with each wall.

9. An inflatable seat as claimed in claim 8, wherein the cushions are arranged to form a buttress for the wall.

10. An inflatable seat as claimed in claim 1, including internal anchoring points to which a baby's restraining harness can be clipped, and external anchoring points so that the seat can be externally secured.

11. An inflatable seat as claimed in claim 1, wherein the walls of the seat include outside pockets or loops of the type adapted to receive toys of feeding utensils.

12. An inflatable seat as claimed in claim 1, wherein the height of the inflatable wall is greatest at the back of the seat and tapers downwards from the back towards the point at which the baby's feet will be.

13. An inflatable seat as claimed in claim 3, wherein the base is made of two sheets of plastics material having a space therebetween, the space between the sheets providing a storage space.

14. An inflatable seat as claimed in claim 12, wherein the inflatable wall is constructed with a plurality of inflatable chambers, all of which intercommunicate so that they can be all inflated through a single inflation valve.

15. An inflatable seat as claimed in claim 14, wherein the inflatable support cushions also intercommunicate with the inflatable chambers in the walls, so that these can also be inflated with the walls.

16. An inflatable seat as claimed in claim 15, wherein all of the inflatable areas are formed in one manufacturing step using two superimposed sheets of plastics material which are welded to one another around the edge and at other suitable positions to define the desired shape of the walls and cushions.

* * * * *